US006229489B1

(12) United States Patent
Holshouser et al.

(10) Patent No.: US 6,229,489 B1
(45) Date of Patent: May 8, 2001

(54) RETRACTABLE DUAL-BAND ANTENNA SYSTEM WITH PARALLEL RESONANT TRAP

(75) Inventors: Howard Eugene Holshouser, Efland; Gerard J. Hayes, Wake Forest, both of NC (US)

(73) Assignee: Ericsson Inc., Research Triangle Park, NC (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/022,265

(22) Filed: Feb. 11, 1998

(51) Int. Cl.[7] ..... H01Q 1/24
(52) U.S. Cl. ..... 343/702; 343/895; 343/722
(58) Field of Search ..... 343/702, 895, 343/722, 745, 749; H01Q 1/24

(56) References Cited

U.S. PATENT DOCUMENTS

| | | | | |
|---|---|---|---|---|
| 5,374,937 | | 12/1994 | Tsunekawa et al. | 343/702 |
| 5,583,519 | | 12/1996 | Koike | 343/702 |
| 5,898,406 | * | 4/1999 | Matero | 343/702 |
| 6,011,516 | * | 1/2000 | Minegishi et al. | 343/702 |

FOREIGN PATENT DOCUMENTS

814536A2 * 12/1997 (EP) ..... H01Q/1/24

* cited by examiner

*Primary Examiner*—Hoanganh Le
(74) *Attorney, Agent, or Firm*—Myers Bigel Sibley & Sajovec

(57) ABSTRACT

Dual-band retractable radiotelephone antennas have an elongated antenna element, a top load element, and a trap positioned between and electrically connected to the elongated antenna element and the top load element. The trap facilitates obtaining half-wave monopole performance at a first frequency band and half-wave monopole performance at a second higher frequency band.

12 Claims, 3 Drawing Sheets

RETRACTABLE DUAL-BAND ANTENNA SYSTEM WITH PARALLEL RESONANT TRAP

FIELD OF THE INVENTION

The present invention relates generally to radiotelephones, and, more particularly, to retractable antenna systems for use with radiotelephones.

BACKGROUND OF THE INVENTION

Radiotelephones generally refer to communications terminals which provide a wireless communications link to one or more other communications terminals. Radiotelephones may be used in a variety of different applications, including cellular telephone, land-mobile (e.g., police and fire departments), and satellite communications systems.

Many radiotelephones, particularly handheld radiotelephones, employ retractable antennas which may be extended out of, and retracted back into, the radiotelephone housing. Typically, retractable antennas are electrically connected to a printed circuit board located within the radiotelephone housing that contains radio frequency circuitry. The antenna and the radio frequency circuitry are typically interconnected such that the impedance of the antenna and the impedance of the radio frequency circuitry are substantially matched. Because radiotelephones use 50 ohm (Ω) impedance coaxial cable or microstrip transmission lines to connect the antenna to the radio frequency circuitry, such matching typically involves mechanically adjusting or electrically tuning the antenna so that it exhibits an impedance of approximately 50 ohms at its connection with the coaxial cable or microstrip transmission line.

Unfortunately, matching the impedance of a retractable antenna may be difficult because the antenna impedance may be dependent on the position of the antenna with respect to both the housing of the radiotelephone and the printed circuit board which contains the radio frequency circuitry. As these respective positions change when the antenna is moved between the extended and retracted positions, an antenna typically exhibits at least two different impedance states, both of which should be matched to the 50 ohm impedance of the feed from the printed circuit board. Accordingly, with retractable antennas, it is generally desirable to provide an impedance matching system that provides an acceptable impedance match between the antenna and the radio frequency circuitry, both when the antenna is retracted, and when the antenna is extended.

"Dual-band" radiotelephones transmit and receive signals in two or more separated frequency bands. Exemplary dual-band radiotelephones are those used with various satellite communications systems that employ widely separated transmit and receive frequency bands (e.g., 800 MHz and 1900 MHz). High performance 800 MHz radiotelephone antennas often take the form of a top loaded half-wave monopole. A helical top loading section may be used to mechanically shorten the antenna structure while maintaining the performance of a half-wave antenna. In the retracted position, the helical top loading section performs as a quarter-wave helical antenna. Dual-band performance may be achieved by either using a parasitic element in the helical top loading section that is resonant at 1900 MHz, or by inducing a secondary resonance in the helical top loading section at 1900 MHz.

Unfortunately, it may be difficult to deliver sufficient power to resonate the parasitic element or the helical top loading section at 1900 MHz when the antenna is in an extended position. As a result, performance approaching a half-wave monopole at 1900 MHz may be difficult to achieve. Performance may often be better when the antenna is in a retracted position. Furthermore, severe constraints may be placed on a matching network to achieve the band width and power transfer necessary for satisfactory dual-band radiotelephone performance.

SUMMARY OF THE INVENTION

It is, therefore, an object of the present invention to provide retractable radiotelephone antennas that take the form of a top loaded half-wave monopole at one frequency band yet can still realize half-wave performance at a second, higher frequency band.

It is another object of the present invention to provide dual-band retractable radiotelephone antennas without requiring complex impedance matching systems.

These and other objects of the present invention are provided by a dual-band retractable radiotelephone antenna configured to radiate in separate frequency bands and having an elongated antenna element, a top load element, and a trap positioned between and electrically connected to the elongated antenna element and the top load element. The top load element includes a helical coil having a center axis generally parallel with a longitudinal direction of the elongated antenna element. A parasitic element is positioned adjacent to the coil to facilitate dual-band operation.

The trap includes an inductor element and a capacitor element electrically connected in parallel. The trap is configured to have a predetermined first impedance at one frequency band and a second predetermined impedance, greater than the first impedance, at the second frequency band. The trap may be configured to be resonant at the second frequency band. The trap allows the elongated antenna element and the top load element to have a combined electrical length of approximately one-half a wavelength of a center frequency of the first frequency band. The trap also allows the elongated antenna element to have an electrical length of approximately one-half a wavelength of a center frequency of the second frequency band. Accordingly, the present invention provides a dual-band radiotelephone antenna with half-wave monopole performance at a first frequency band and half-wave monopole performance at a second, higher frequency band without requiring a complex impedance matching system.

BRIEF DESCRIPTION OF THE DRAWINGS

The accompanying drawings, which are incorporated in and constitute a part of the specification, illustrate an embodiment of the invention and, together with the description, serve to explain the principles of the invention.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
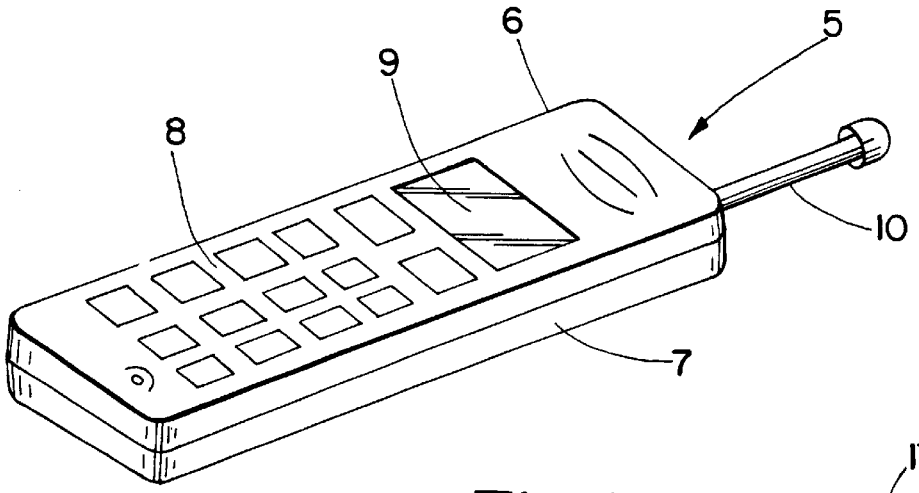
FIG. 1 illustrates an exemplary radiotelephone.

Referring now to FIG. 1, a conventional radiotelephone 5 includes a handset unit 6 enclosed within a housing 7. The housing 7 encloses a transceiver that enables the radiotelephone 5 to transmit and receive telecommunications signals. A keypad 8, display window 9, and retractable antenna 10 for receiving telecommunications signals, facilitate radiotelephone operation. Other elements of radiotelephones are conventional and need not be described herein.

Figure 2A:
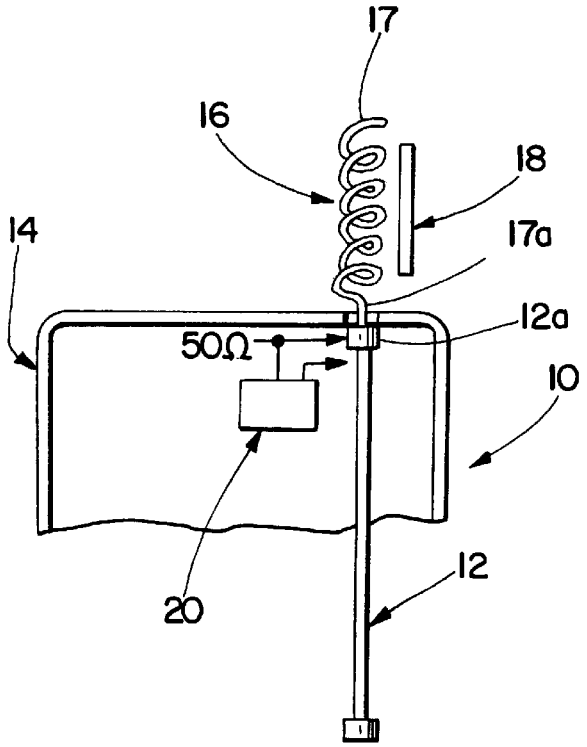
Fig. 2A (PRIOR ART)
FIGS. 2A and 2B illustrate a conventional dual-band retractable antenna system for radiotelephones.
Figure 2B:
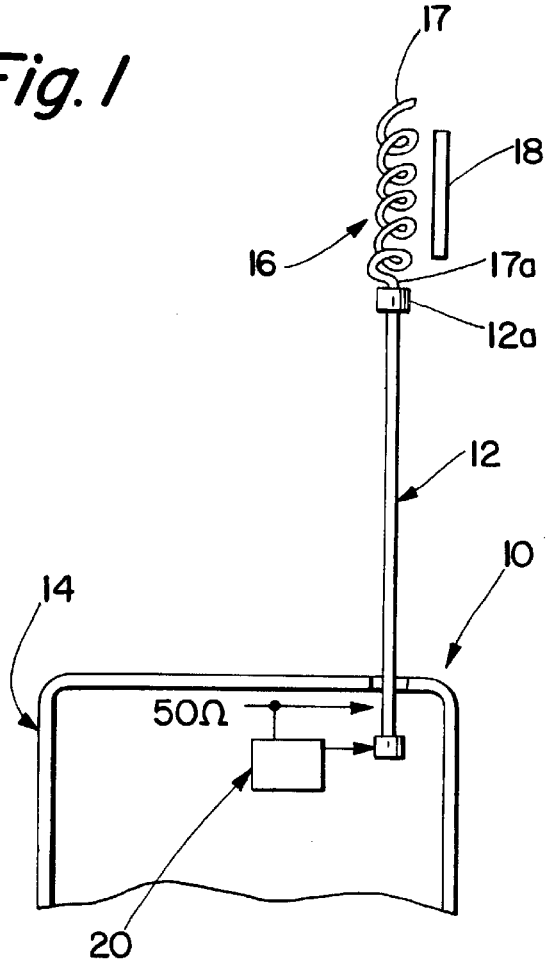
Fig. 2B (PRIOR ART)

Referring now to FIGS. 2A and 2B, a conventional dual-band retractable radiotelephone antenna 10 is schematically illustrated. The antenna 10 includes a linear rod 12 slidably mounted within a radiotelephone housing 14, and movable between a retracted position (FIG. 2A) and an extended position (FIG. 2B) via an aperture (not shown) in the housing. Mounted at an upper end 12*a* of the linear rod 12 is a top load element 16. The top load element 16 is configured as a helical coil 17 and has a center axis that coincides essentially with the longitudinal direction of the linear rod 12. One end of the helical coil is free-standing and the other end of the helical coil is electrically connected to the linear rod 12. As is known to those skilled in the art, dual-band operation may be achieved through the use of a parasitic element 18 positioned adjacent to the helical coil 17 and generally parallel with the center axis thereof.

A matching network 20 is provided to match the impedance of the antenna 10 to the 50 ohm impedance of the radio frequency (RF) circuitry (not shown) of the radiotelephone. The matching network 20 employs dual impedance matching circuits, one of which is associated with the retracted antenna position (FIG. 2A), and the other which is associated with the extended antenna position (FIG. 2B). In the retracted position (FIG. 2A), the base 17*a* of the helical coil 17 presents a 50 ohm match to the terminal at 800 MHz. Operation at 1900 MHz is supported by the parasitic element 18 adjacent to the helical coil 17. Electrically, the linear rod 12 of the antenna 10 is connected at 1900 MHz and generates some level of performance degradation due to energy radiating away from it. In the extended position (FIG. 2B), the antenna 10 represents a half-wave monopole at 800 MHz which is matched to 50 ohms through the matching network 20.

Figure 3:
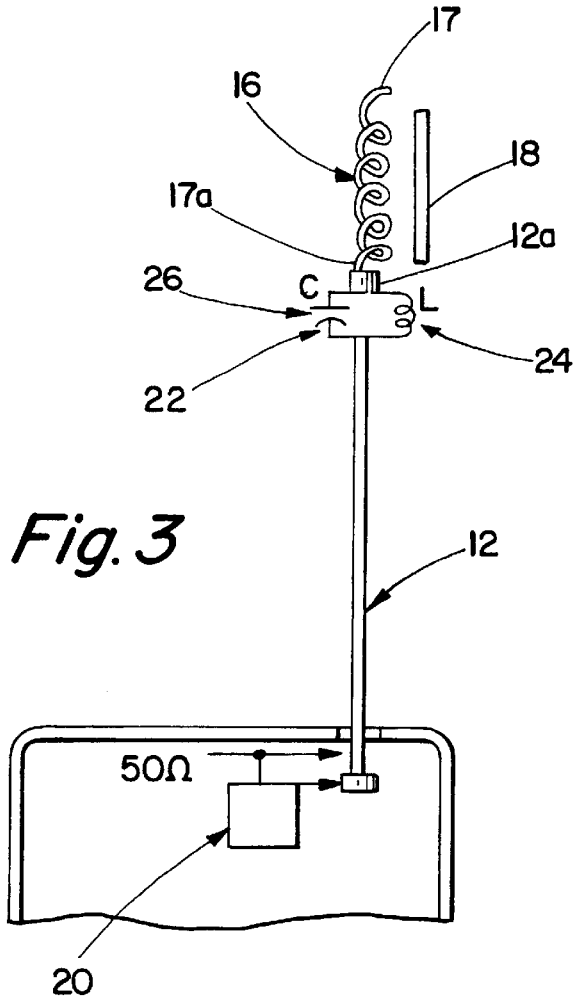
FIGS. 3 and 5 illustrate a parallel resonant trap, according to the present invention, positioned between the linear rod and the helical top load element of a dual-band retractable radiotelephone antenna.

Referring now to FIG. 3, a parallel resonant trap 22 is positioned between the linear rod 12 of the antenna 10 and the top load element 16. The illustrated parallel resonant trap 22 includes an inductor element 24 and a capacitor element 26 connected in parallel with each other. However, as known to those skilled in the art, the parallel resonant trap 22 may be implemented as lumped elements, in printed wire board patterns, or as coaxial components, and the like. The parallel resonant trap 22 is configured to be resonant at 1900 MHz, thereby having a high impedance, yet have a relatively small impedance at 800 MHz. Accordingly, at 800 MHz the antenna 10 still performs as a half-wave monopole in the extended position. It is to be understood that the ratio of the inductor element 24 and capacitor element 26 can be configured to allow the parallel resonant trap 22 to have low and high impedance at various selected frequencies.

The relative dimensions of the linear rod 12 and the helical coil 17 are adjusted by the parallel resonant trap 22 so that the linear rod 12 is near a half-wave length at 1900 MHz and the helical coil 17 is near a quarter-wave at 800 MHz. At 1900 MHz, when the antenna 10 is in the extended position, the parallel resonant trap 22 prevents energy from entering the helical coil, due to the high impedance of the parallel resonant trap.

Figure 4A:
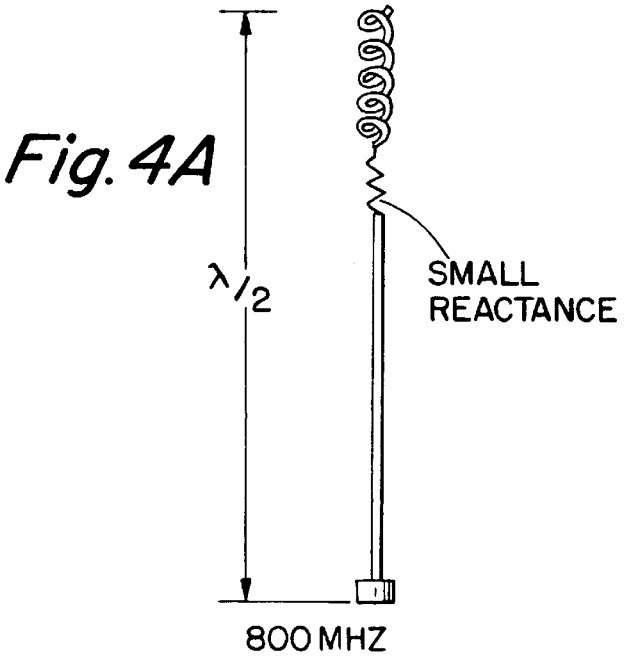
FIGS. 4A–4B illustrate the equivalent circuits at 800 MHz and 1900 MHz caused by the parallel resonant trap illustrated in FIG. 3.
Figure 4B:
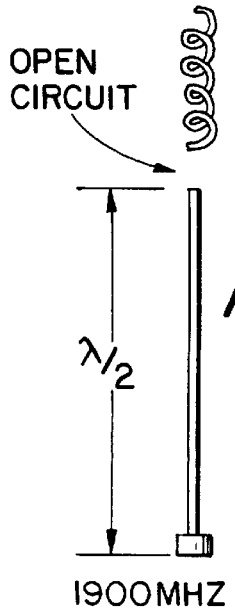

Referring to FIGS. 4A–4B, the equivalent circuits at 800 MHz and 1900 MHz caused by the parallel resonant trap 22 are illustrated. At 800 MHz, the parallel resonant trap 22 has small reactance (low impedance) thereby allowing energy to reach the helical coil 17 (FIG. 4A). At 1900 MHz, the parallel resonant trap 22 effectively opens the circuit because of high impedance, thereby preventing energy from passing from the helical coil 17 through the linear rod 12 (FIG. 4B).

Figure 5:
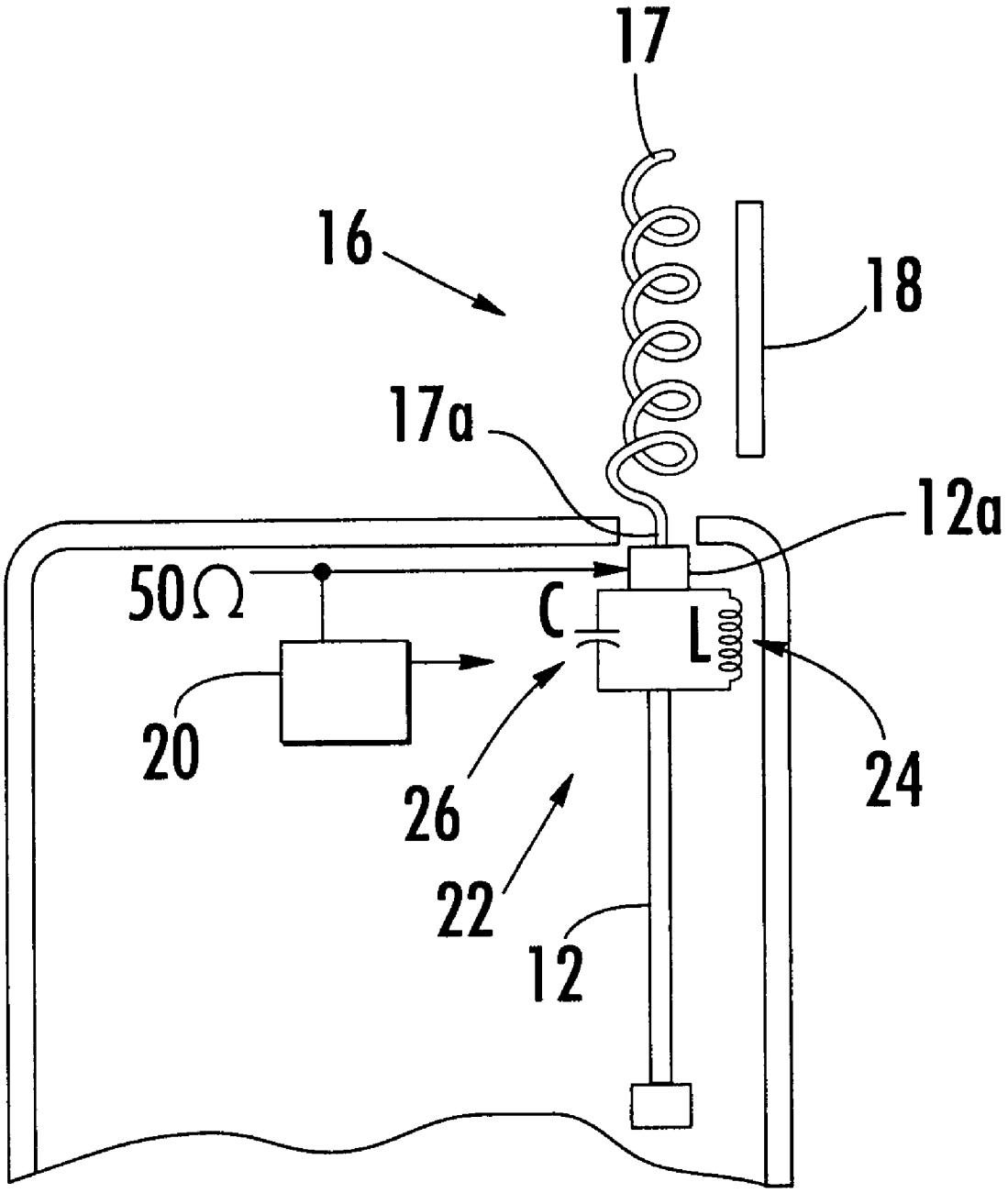

Accordingly, in the extended position, the antenna 10 performs as a half-wave monopole with a small series reactance at 800 MHz and as a half-wave monopole at 1900 MHz. In the retracted position, the helical coil 17 of the antenna 10 performs as a quarter-wave monopole at 800 MHz and as a quarter-wave monopole at 1900 MHz with the parasitic element 18. In the retracted position as illustrated in FIG. 5, the linear rod 12 is effectively electrically disconnected from the helical coil so that energy is not permitted to leak down the linear rod and be absorbed by the radiotelephone user's hand. Accordingly, the present invention can provide a radiotelephone antenna with half-wave monopole performance at 800 MHz and half-wave monopole performance at 1900 MHz without requiring a complex mechanical structure.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A radiotelephone having a retractable dual-band antenna configured to radiate in a selected one of separate first and second frequency bands, wherein said second frequency band is greater than said first frequency band, said radiotelephone comprising:

a radiotelephone housing;

a transceiver disposed within said radiotelephone housing;

an elongated antenna element movably mounted within said housing and extendible from the housing so as to have an extended position and a retracted position, said elongated antenna element electrically coupled with said transceiver;

a top load element that extends from the radiotelephone housing when the elongated antenna element is in the extended position and when the elongated antenna element is in the retracted position, the elongated antenna element being disposed between the top load element and the radiotelephone housing when the elongated antenna element is in the extended position, a trap positioned between and electrically connected to said elongated antenna element and said top load element such that said trap has no overlap with said top load element and is disposed within said housing when the elongated antenna element is in the retracted position, said trap configured to have a first impedance at said first frequency and a second impedance, greater than said first impedance, at said second frequency.

2. A radiotelephone according to claim 1 wherein said top load element comprises a coil having a center axis generally parallel with a longitudinal direction of said elongated antenna element.

3. A radiotelephone according to claim 2 wherein said top load element comprises a parasitic element adjacent said coil.

4. A radiotelephone according to claim 1 wherein said trap comprises an inductor element and a capacitor element electrically connected in parallel.

5. A radiotelephone according to claim 1 wherein said first frequency is 800 MHz and said second frequency is 1900 MHz.

6. A radiotelephone according to claim 1 wherein said wherein said trap is resonant at said second frequency.

7. A radiotelephone according to claim 1 wherein said elongated antenna element and said top load element have a combined electrical length of approximately one-half a wavelength of a center frequency of said first frequency band when said elongated antenna element is in said extended position.

8. A radiotelephone according to claim 1 wherein said top load element has an electrical length of approximately one-half a wavelength of a center frequency of said second frequency band when said elongated antenna element is in said retracted position.

9. A radiotelephone having a retractable dual-band antenna configured to radiate in a selected one of separate first and second frequency bands, wherein said second frequency band is greater than said first frequency band, said radiotelephone comprising:

a radiotelephone housing;

a transceiver disposed within said radiotelephone housing;

an elongated antenna element movably mounted within said housing and extendible from the housing so as to have an extended position and a retracted position, said elongated antenna element electrically coupled with said transceiver;

a top load element that extends from the radiotelephone housing when the elongated antenna element is in the extended position and when the elongated antenna element is in the retracted position, the elongated antenna element being disposed between the top load element and the radiotelephone housing when the elongated antenna element is in the extended position, the top load element comprising a coil having a center axis generally parallel with a longitudinal direction of said elongated antenna element and a parasitic element adjacent said coil, wherein said elongated antenna element and said top load element have a combined electrical length of approximately one-half a wavelength of a center frequency of said first frequency band when said elongated antenna element is in said extended position, wherein said top load element has an electrical length of approximately one-half a wavelength of a center frequency of said second frequency band when said elongated antenna element is in said retracted position; and a trap positioned between and electrically connected to said elongated antenna element and said top load element element such that said trap has no overlap with said top load element and is disposed within said housing when the elongated antenna element is in the retracted position, said trap configured to have a first impedance at said first frequency and a second impedance, greater than said first impedance, at said second frequency.

10. A radiotelephone according to claim 9 wherein said trap comprises an inductor element and a capacitor element electrically connected in parallel.

11. A radiotelephone according to claim 9 wherein said first frequency is 800 MHz and said second frequency is 1900 MHz.

12. A radiotelephone according to claim 9 wherein said wherein said trap is resonant at said second frequency.

* * * * *